United States Patent [19]

Toyama

[11] 3,977,353

[45] Aug. 31, 1976

[54] JET POWERED MARINE PROPULSION UNIT

[76] Inventor: James Toyama, 1980 Cedar Ave., Long Beach, Calif. 90806

[22] Filed: July 31, 1974

[21] Appl. No.: 493,638

[52] U.S. Cl. ..... 115/16; 115/34 B

[51] Int. Cl.[2] ..... B63H 11/08

[58] Field of Search ..... 115/34 B, 39, 11 R, 115/11 A, 12, 14, 16; 60/221

[56] References Cited

UNITED STATES PATENTS

| | | | |
|---|---|---|---|
| 1,326,730 | 12/1919 | Helguera | 115/16 |
| 2,636,467 | 4/1953 | Johnson | 115/16 |
| 2,656,809 | 10/1953 | Frasure | 416/177 X |
| 3,155,065 | 11/1964 | Strumskis | 115/16 X |
| 3,185,122 | 5/1965 | Pleuger | 115/34 B X |
| 3,328,961 | 7/1967 | Aschauer | 60/221 |

*Primary Examiner*—Trygve M. Blix
*Assistant Examiner*—Gregory W. O'Connor
*Attorney, Agent, or Firm*—Blair & Brown

[57] ABSTRACT

A jet powered marine propulsion unit includes a pair of spaced parallel conduits extending longitudinally through a ship with intakes adjacent the bow of the ship. A tubular propeller is mounted in the conduits with blades extending inwardly toward the axis of the propeller. The propellers are chain driven from the gear box of a diesel engine. The conduits adjacent their outlet are provided with a plurality of spaced parallel stationary blades arranged parallel to the axis of the conduit to eliminate all swirling action of the jet fluid prior to its expulsion in a propelling jet. The tubular propellers are conical in form to provide a reduced diameter at their outlet ends.

5 Claims, 11 Drawing Figures

FIG. 9.
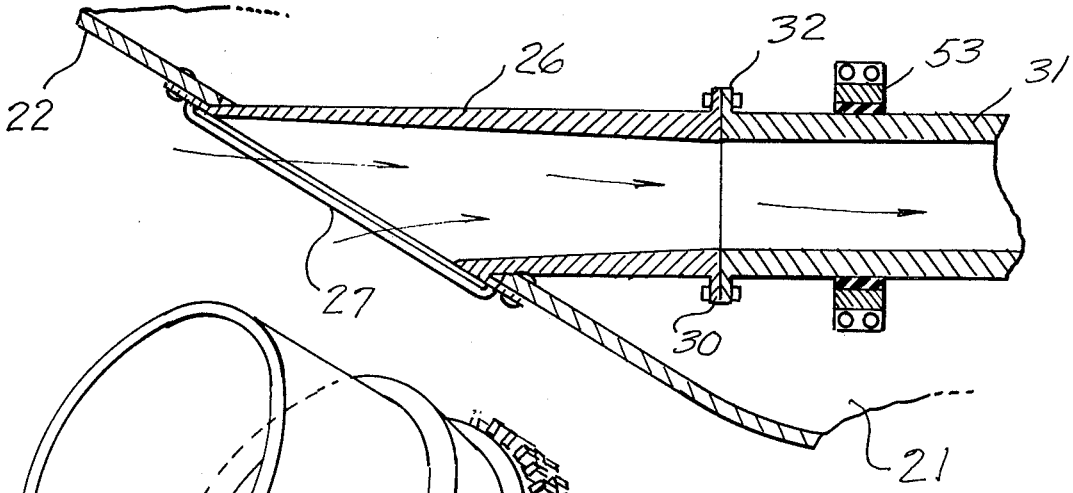
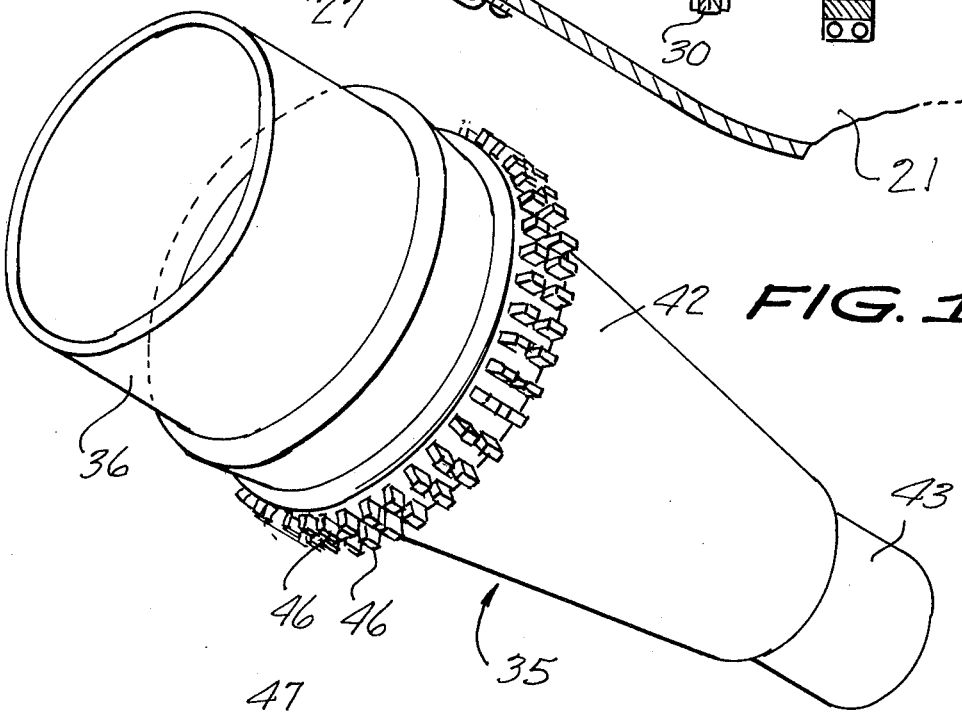
FIG. 10.
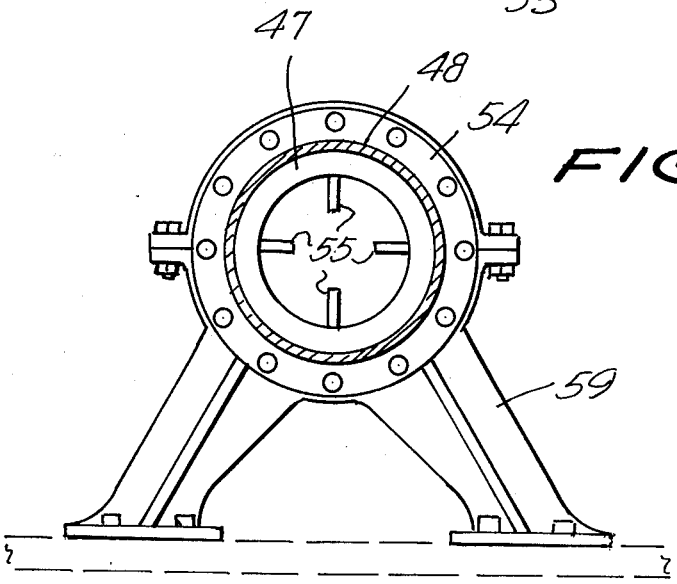
FIG. 8.

JET POWERED MARINE PROPULSION UNIT

BACKGROUND OF THE INVENTION

FIELD OF THE INVENTION

The present invention relates to jet powered marine propulsion unit for moving a ship through the water.

SUMMARY OF THE INVENTION

The jet powered marine propulsion unit of the present invention includes a pair of spaced conduits extending from the bow of a ship to the stern in spaced parallel relation and parallel to the longitudinal axis of the ship. Intermediate the ends of the conduits conical tubular propellers are mounted with blades extending inwardly toward but not reaching the axis of the propeller. The propellers are rotated by a diesel engine through a gear box and have the reduced diameter portion of the propeller at the rear to assist in concentrating the forces of the jet. At the rear of the conduit adjacent the jet exit a plurality of spaced parallel blades parallel to the axis of the conduit are arranged to eliminate all swirling action of the fluids prior to their expulsion as a jet.

The primary object of the invention is to provide an efficient jet powered marine propulsion unit as a substantially closed system.

Other objects and advantages will become apparent in the following specification when considered in light of the attached drawings.

BRIEF DESCRIPTION OF THE DRAWINGS

FIG. 8 is a transverse sectional view taken along the lines 8—8 of FIG. 6, looking in the direction of the arrows;

FIG. 9 is a horizontal sectional view taken along the line 9—9 of FIG. 1, looking in the direction of the arrows;

FIG. 10 is a perspective view of the tubular propeller detached from a unit.

DESCRIPTION OF THE PREFERRED EMBODIMENT

Figure 1:
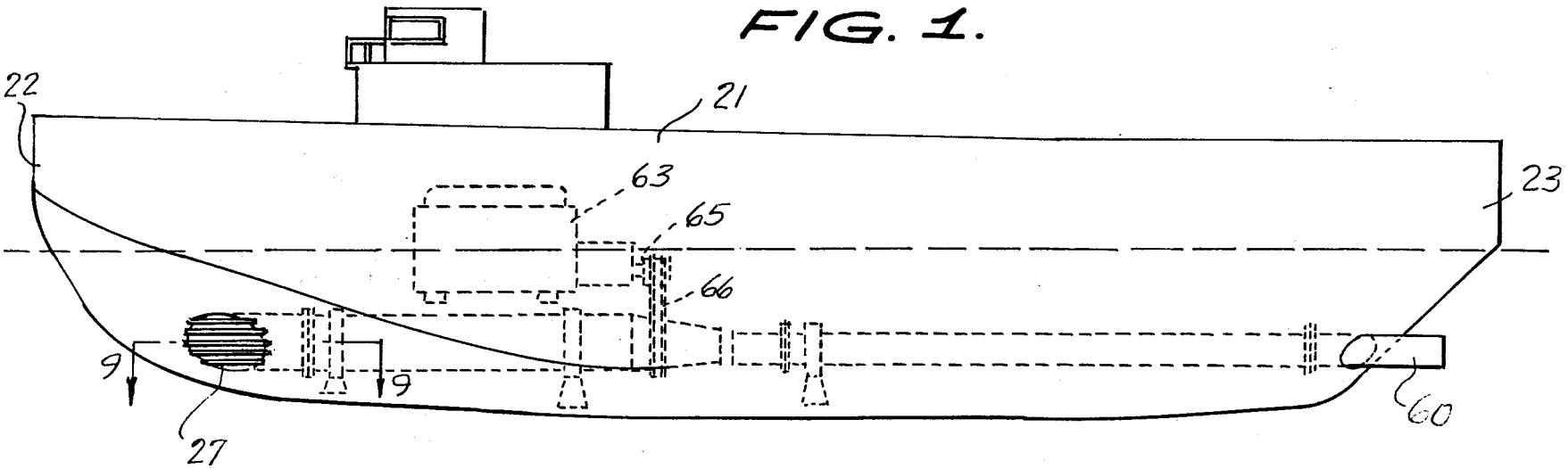
FIG. 1 is a side elevation of the invention.
Figure 2:
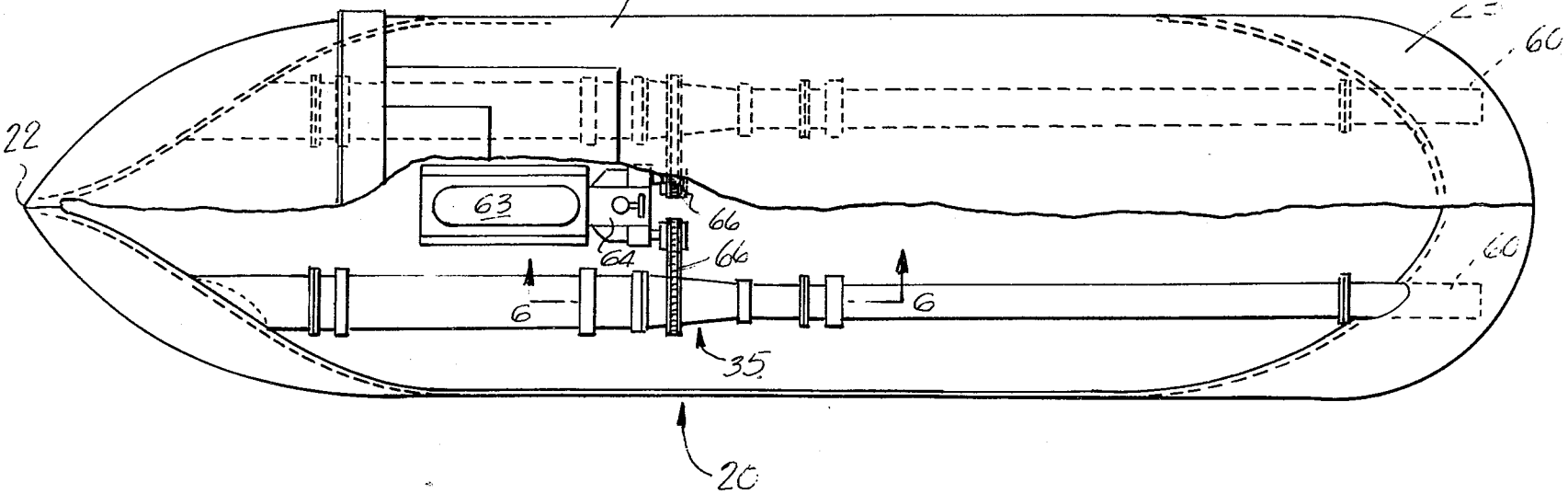
FIG. 2 is a top plan view of the invention shown partially broken away and in section for convenience of illustration.
Figure 3:
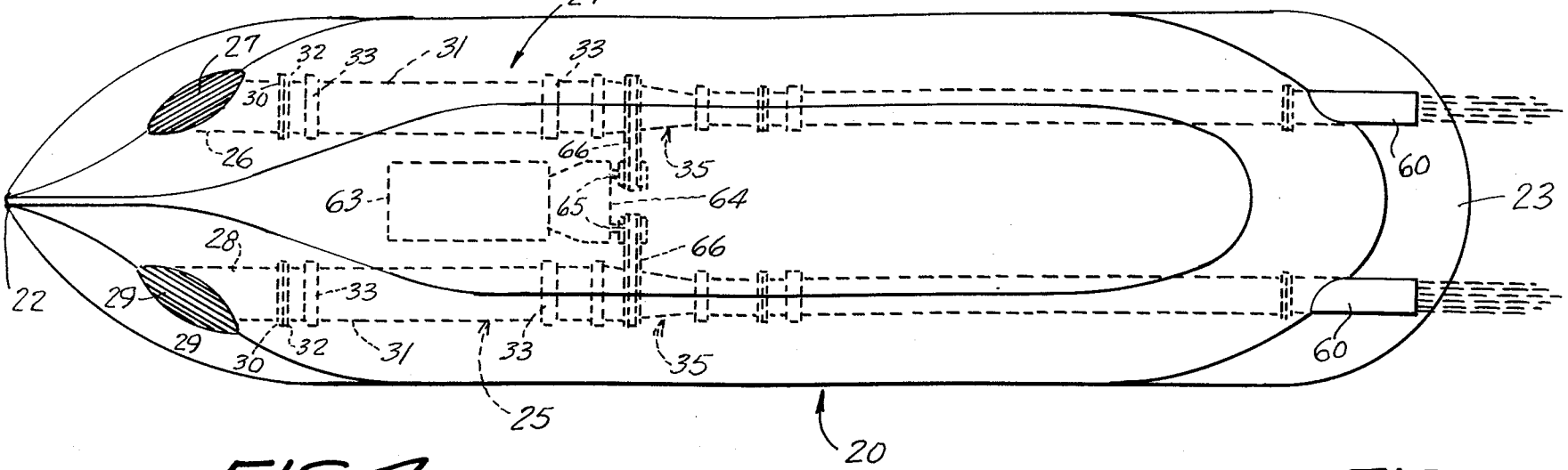
FIG. 3 is a bottom plan view of the invention.
Figure 5:
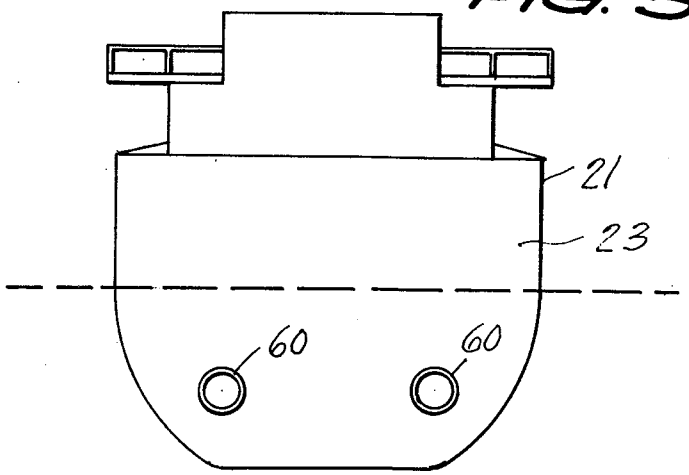
FIG. 5 is a rear elevation of the unit.
Figure 4:
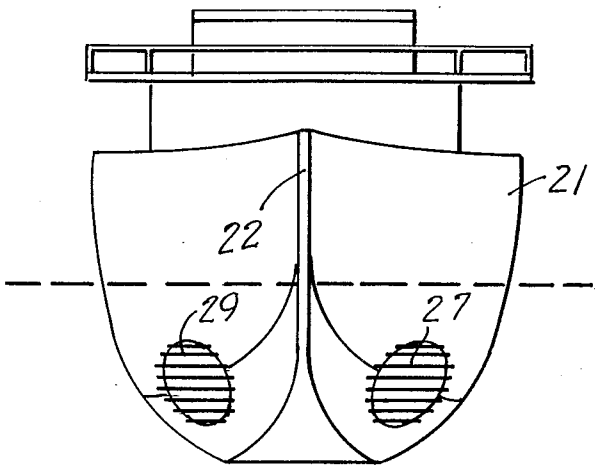
FIG. 4 is a front elevation of the unit.

Referring now to the drawings in detail, wherein like reference characters indicate like parts throughout the several figures, the reference numeral 20 indicates a jet powered marine propulsion unit constructed in accordance with the invention. The marine propulsion unit 20 is used on a ship 21 having a bow 22 and a stern 23.

The unit 20 consists of a pair of conduits generally indicated at 24 and 25 which are substantially identical in form. The conduit 24 includes an intake segment 26 which extends through the bow 22 of the ship 21. A screen 27 covers the opening to prevent trash and debris from entering the conduit 24. The conduit 25 includes an intake segment 28 with its outer end covered by a screen 29 to prevent trash from being drawn into the conduit 25. The portions of the conduits 24, 25 extending rearwardly from the intake segments 26, 28 are identical and the same reference numerals will be used in their description.

The intake segments 26, 28 each have a flange 30 on the rear thereof. A fore segment 31 having a flange 32 on its forward end is mounted on a pair of support blocks 33 with the flanges 30, 32 secured together in watertight relation.

Figure 6:
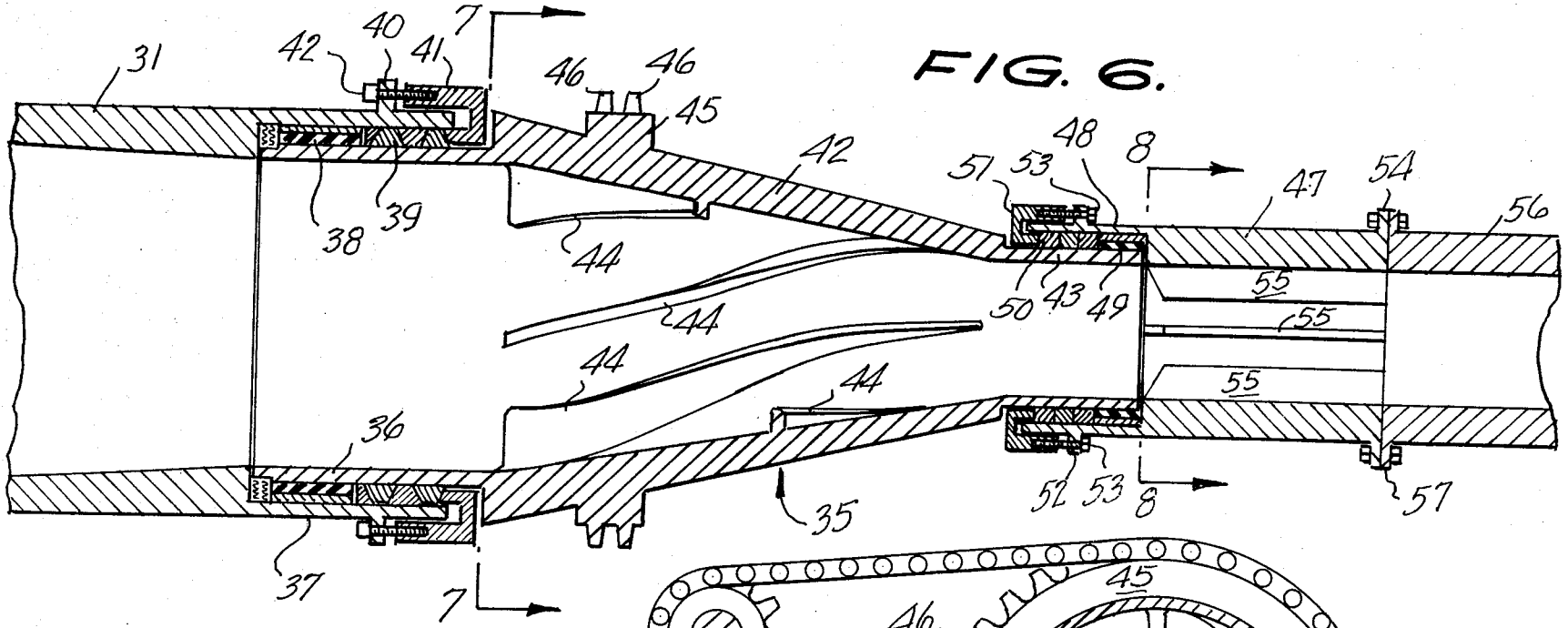
FIG. 6 is an enlarged fragmentary vertical sectional view taken along the line 6—6 of FIG. 2, looking in the direction of the arrows.
Figure 7:
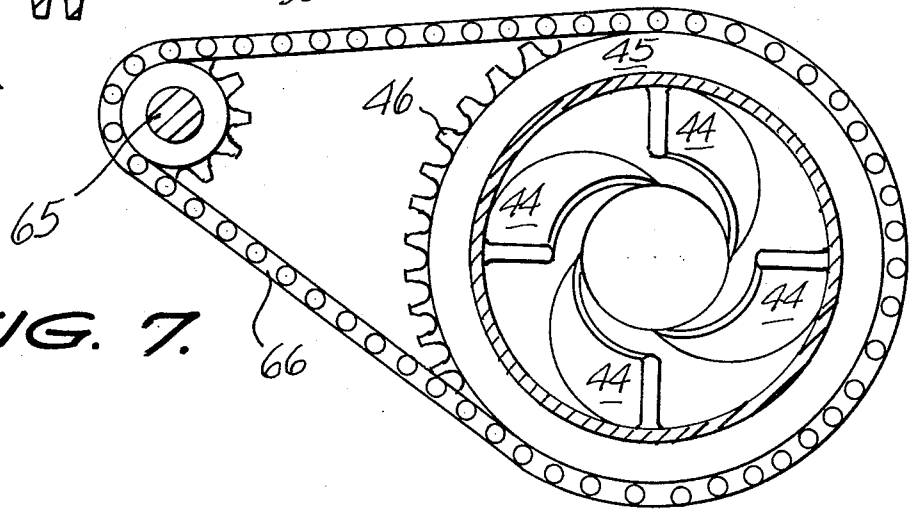
FIG. 7 is a fragmentary transverse sectional view taken along the line 7—7 of FIG. 6, looking in the direction of the arrows.
Figure 11:
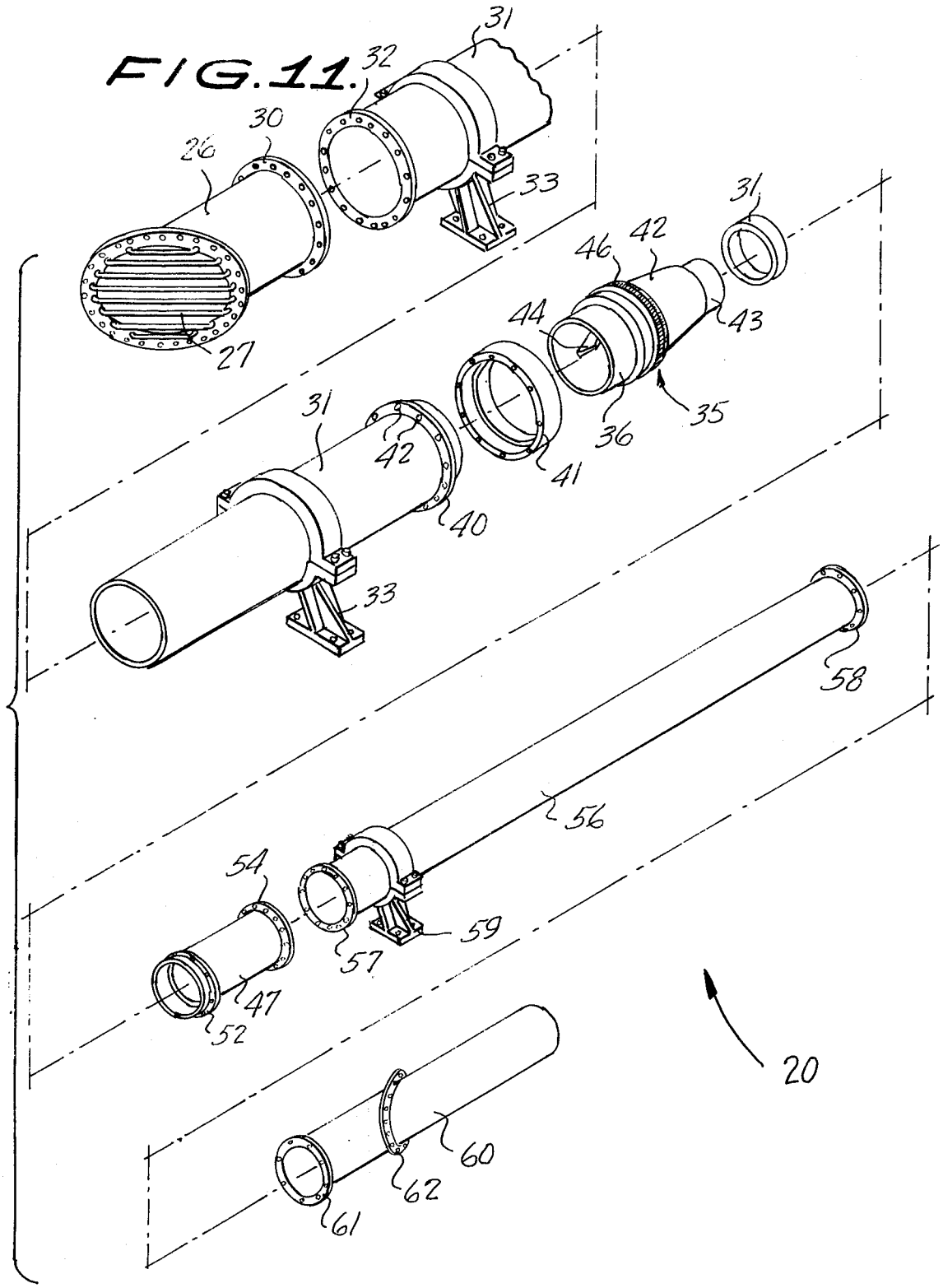
FIG. 11 is an exploded perspective view of the jet powered marine propulsion unit shown removed from the ship.

A tubular propeller generally indicated at 35 has a generally cylindrical portion 36 which engages in a flange 37 formed on the rear end of the fore segment 31. A rubber bearing 38 supports the cylindrical portion 36 in the flange 37 as can be seen in FIG. 6. A plurality of packing rings 39 seal the space between the cylindrical portion 36 and the flange 37 to prevent the flow of water therethrough. A flange 40 is formed on the rear end of the fore segment 31 and a circular packing ring squeezer 41 having a J-shaped cross section is adjustably secured to the flange 40 by a plurality of cap screws 42. Tightening of the cap screws 42 draws the J-shaped packing ring squeezer 41 toward the packing rings 39 to increase the sealing quality thereof.

A hollow conical body 42 extends integrally forwardly from the cylindrical portion 36 of the propeller 35 with its smallest cross section extending forwardly. The conical body 42 has a cylindrical extension 43 at the forward end thereof as can be seen in FIG. 6. A plurality of propeller blades 44 having an elongate spirl form are cast within the conical body 42 and extend inwardly thereof toward the axis of the propeller 35. The blades 44 reduce in size toward the rear of the propeller 35. A cylindrical ring 45 is formed on the body 42 outwardly thereof and has a pair of chain gears 46 formed thereon. The conduits 24, 25 have a rear bearing segment 47 with a forward flange 48 formed thereon. The cylindrical extension 43 of the propeller 35 extends into the flange 48 and is supported on a rubber bearing 49. Sealing rings 50 are positioned between the cylindrical portion 43 and the flange 48 to seal against the flow of water therebetween. A circular packing ring squeezer 51 having a J-shaped cross section is secured to a flange 52 on the rear bearing segment 47 by means of a plurality of cap screws 53. Tightening of the cap screws 53 causes the packing ring squeezer 51 to squeeze the packing rings 50 so as to increase the sealing quality thereof. The rear bearing segment 47 has an external flange 54 at the rear thereof for reasons to be assigned.

A plurality of spaced parallel stationary blades 55 extend inwardly from the inner wall of the rear bearing segment 47 parallel to the axis of the segment 47 as can be seen in FIG. 6.

A rear conduit segment 56 has a flange 57 at its forward end secured to the flange 54 and a flange 58 at its rear end. A support block 59 supports the rear conduit segment 56. An outlet segment 60 has an external flange 61 on its forward end which is secured to the flange 58. An external flange 62 is mounted on the outlet segment 60 at an angle to fit the stern 23 of the ship 21.

A diesel engine 63 is mounted centrally of the ship 21 and has a gear box 64 associated therewith. The gear box 64 has a pair of output shafts 65 connected by chains 66 to the chain gears 46 on the propeller 35.

In the use and operation of the invention the propellers 35 are driven from the gear box 64 by the diesel engine 63 and water is drawn in through the screen 27, 29 by action of the propellers 35 and is expelled through the outlet segments 60 as a jet stream. The conical shape of the propeller 35 with its reduced cross section at the rear thereof increases the jet force of the fluids flowing through the unit 20. The stationary blades 55 in the rear bearing segment 47 removes the swirling action from the fluids caused by the propeller 35 so that the fluid as it flows rearwardly out of exhaust segment 60 will have a smooth flow.

By controlling the speed of the individual propellers 35 through the gear box 64 the ship 21 can be steered without the necessity of a rudder. The ship 21 can be moved in a reverse direction by reversing the direction of the propellers 35 so as to cause a jet flow from the forward end of the units 20. The reverse operation of the units 20 is substantially less efficient than the operation in a foward direction.

Having thus described the preferred embodiment of the invention it should be understood that numerous structural modifications and adaptations may be resorted to without departing from the spirit of the invention.

What is claimed is:

1. A jet powered marine propulsion unit comprising an elongate conduit adapted to extend in a direct straight line longitudinally through a ship from the bow to the stern thereof, a hollow conical shaped propeller mounted in said conduit intermediate the opposite ends thereof with the smallest cross section thereof extending rearwardly, a plurality of blades of elongate spiral form in said propeller extending toward the axis thereof but spaced therefrom, means mounting said propeller for rotation in said conduit and means for driving said propeller.

2. A device as claimed in claim 1 including means sealing said propeller to said conduit to prevent leakage of water therebetween.

3. A device as claimed in claim 1 including a plurality of stationary blades formed internally of said conduit rearwardly of said propeller with said blades arranged in spaced parallel relation parallel to axis of said conduit by eliminating swirling motion of the water flowing from said propeller.

4. A device as claimed in claim 1 wherein the means for driving said propeller includes a chain gear integrally formed on the external surface of said propeller and a chain drive extending from said driving means to said propeller.

5. A device as claimed in claim 1 wherein said conduit has a diameter substantially smaller rearwardly of said propeller than the diameter forwardly of said propeller.

* * * * *